United States Patent [19]

Bastiaansen

[11] Patent Number: 5,038,941

[45] Date of Patent: Aug. 13, 1991

[54] HAT RACK

[76] Inventor: Jac Bastiaansen, Box 352, Bow Island, Alberta T0K 0G0, Canada

[21] Appl. No.: 605,133

[22] Filed: Oct. 30, 1990

Related U.S. Application Data

[63] Continuation of Ser. No. 491,064, Mar. 9, 1990, abandoned.

[51] Int. Cl.[5] ..... A47F 7/00

[52] U.S. Cl. ..... 211/32; 211/89

[58] Field of Search ..... 211/32, 89, 120, 71; 248/316.7, 316.1

[56] References Cited

U.S. PATENT DOCUMENTS 179,765 7/1876 Bryan ..... 211/32

807,757 12/1905 Martin ..... 211/32 X 1,478,209 12/1923 Eaton ..... 211/32 X

FOREIGN PATENT DOCUMENTS 1555703 12/1968 France ..... 211/89

273878 7/1927 United Kingdom ..... 211/89

*Primary Examiner*—Alvin C. Chin-Shue

*Assistant Examiner*—Sarah A. Lechok

*Attorney, Agent, or Firm*—Shlesinger Arkwright & Garvey

[57] ABSTRACT

This invention relates to a hat clamp and rack used for holding and displaying baseball-style caps. The hat clamp holds the hat in a position such that the front portion of the hat, which usually includes some form of advertisement, is fully visible for unobstructed viewing.

7 Claims, 1 Drawing Sheet

HAT RACK

This application is a continuation of application Ser. No. 07/491,064, now abandoned filed Mar. 9, 1990.

BACKGROUND OF THE INVENTION

This invention relates to a hat clamp and rack, combination for displaying baseball-style caps.

Baseball-style hats, which are often received as gifts or collected as souvenirs usually end up in the back of a closet where no one can see or find them. Moreover, recently a great deal of creative effort has been devoted to the designing and ornamentation of such hats. Consequently, there is a need for a clamp or holder which displays the hat or hats, and in particular the front portions of such hats.

The object of the present invention is to meet the above need by providing a hat clamp and a hat rack, which facilitates easy and attractive display of a plurality of such hats in the minimum amount of space.

BRIEF SUMMARY OF THE INVENTION

Accordingly, the present invention relates to a baseball-style hat retaining clamp comprising a central base portion and first and second opposed and converged spring finger means integral with said base portion of extending outwardly therefrom, said finger means being utilized to grasp the top rear of a hat in the folded and storage position.

In a further embodiment of the invention there is disclosed a rack for a baseball-style hat comprising baseplate means for mounting the rack on a vertical surface; and a plurality of clamp means, each said clamp means including upper and lower, opposed, spring finger means for grasping the top rear of a hat in the folded or storage position.

BRIEF DESCRIPTION OF THE DRAWINGS

The invention will be described in greater detail with reference to the accompanying drawing, which illustrates a preferred embodiment of the invention, and wherein.

DESCRIPTION OF THE PREFERRED EMBODIMENT(S)

With reference to the drawings, the hat rack of the present invention includes a long, thin, rectangular baseplate 1, and a plurality of spaced apart clamps generally indicated at 2 secured to baseplate 1 by rivets 3. Holes 4 and 5 are provided in the top and bottom end of baseplate 1 to facilitate mounting of the baseplate on a vertical surface.

Figure 1:
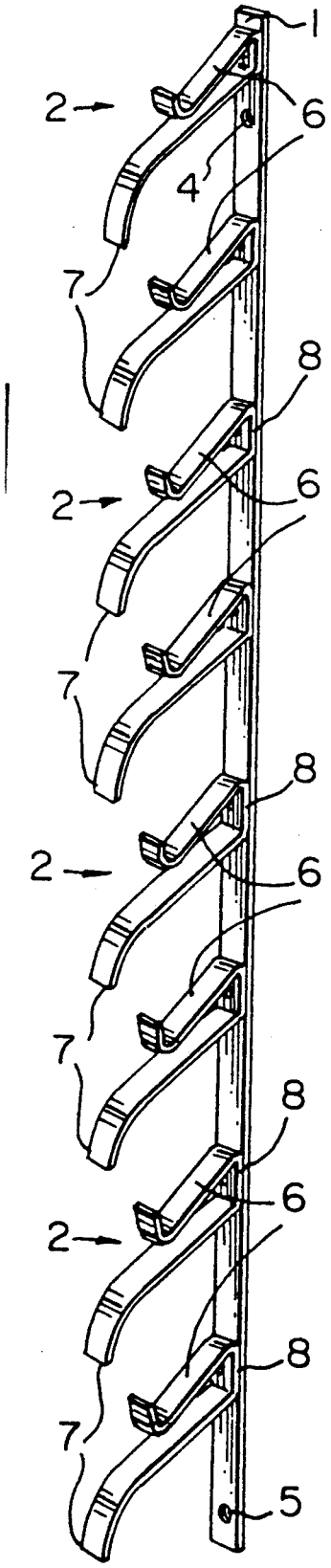
FIG. 1 is a perspective view of a hat rack in accordance with the invention.
Figure 2:
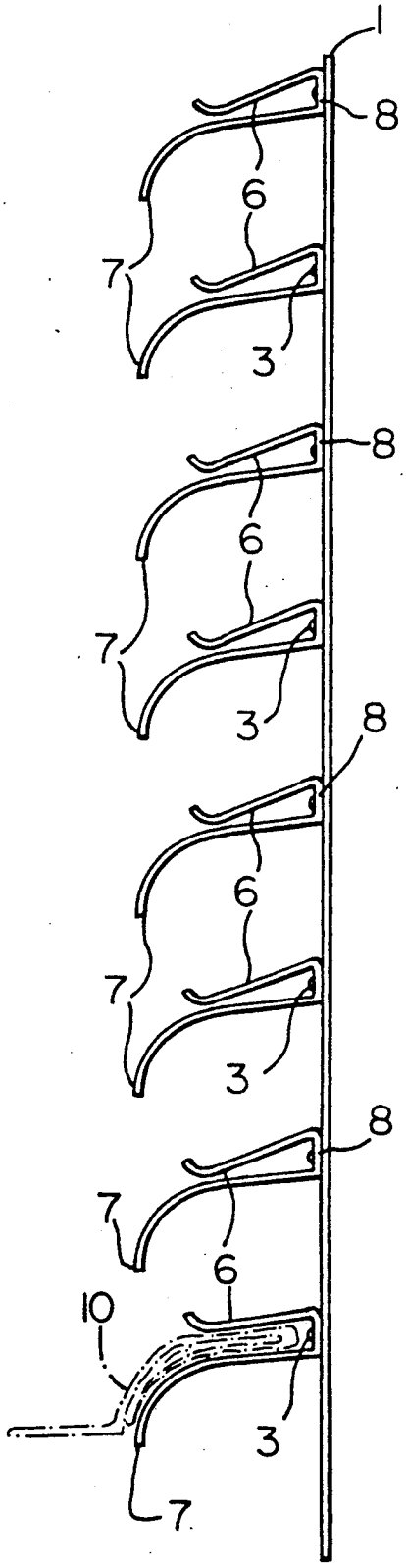
FIG. 2 is a side view of the hat rack of FIG. 1.
Figure 3:
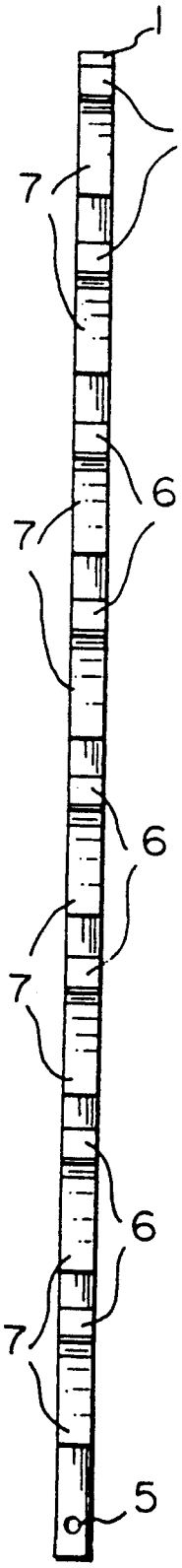
FIG. 3 is a front view of the hat rack of FIGS. 1 and 2.

As best shown in FIG. 2, each clamp 2 is formed from a single thin, rectangular strip of resilient material, metal or unbreakable plastic which is bent to define upper and lower, opposed spring fingers 6 and 7, respectively and a central mounting portion 8 for receiving rivets 3. Both of the fingers 6 and 7 extend outwardly and downwardly. The fingers 6 and 7 converge outwardly. The upper spring finger 6 curves slightly upwardly at the outer end thereof, and the lower spring finger 7 curves downwardly at the outer end thereof to facilitate insertion of a hat 10 (FIG. 2) between the fingers. The finger 7 extends farther from the baseplate 1 than the upper spring finger 6 for bearing against the front, top portion of the hat 10.

The rack is designed to receive a plurality of hats 10 in the folded or storage condition, i.e. with the back half of the hat folded under and into contact with the front half of the hat.

The spring fingers 6 and 7 clamp the folded portion of the hat. As mentioned above, because the lower finger 7 extends outwardly beyond the upper finger 6 and has an arcuate outer end, the finger 7 maintains the shape of the normally ornamented front of the hat 10.

It will be appreciated that several racks of the type described above can be mounted parallel to each other for holding large numbers of hats.

What I claim is:

1. A retaining clamp for displaying the front portion of a hat, comprising:

a) an integral one-piece member including first and second spring finger means connected by a central member;

b) said first and second finger means extending outwardly downwardly from said central member; c) said first and second finger means covergingly extending along a single vertical plane; d) each of said first and second finger means including a straight section, an arcuate section, and a tip section;

e) said second finger means extending outwardly a substantial distance beyond said tip section of said first finger means;

f) said tip section of said second finger means extending vertically so as to substantially parallel to said central member; and g) said arcuate section of said second finger means being substantially longer in length than said arcuate section of said first finger means for bearing against the top front portion of a hat so as to maintain the natural shape thereof;

h) whereby when a hat is inserted between said first and second finger means in a position that the top rear portion of the hat folded under the top front portion thereof, the retaining clamp displays the top front portion of the hat in its natural shape.

2. The clamp of claim 1, wherein:

a) said central member includes means for attaching the clamp to a support surface.

3. The clamp of claim 1, wherein: a) said one-piece member is made of a resilient material.

4. The clamp of claim 1, wherein:

a) said straight sections of said first and second finger means generally correspond in the lengths thereof.

5. The clamp of claim 1, wherein:

a) said arcuate section of said second finger means has a greater curvature than said arcuate section of said first finger means.

6. The clamp of claim 1, in combination with a rack.

7. A device for displaying the front portions of hats, comprising:

a) baseplate means for mounting the device on a support surface;

b) a plurality of equidistantly spaced retaining clamps provided on said baseplate means for receiving hats; and c) at least one of said retaining clamp comprising:

i) an integral one-piece member including first and second spring finger means connected by a central member;

ii) said first and second finger means extending outwardly downwardly from said central member;

iii) said first and second finger means convergingly extending along a single vertical plane;

iv) each of said first and second finger means including a straight section, an arcuate section, and a tip section;

v) said second finger means extending outwardly a substantial distance beyond said tip section of said first finger means;

vi) said tip section of said finger means extending vertically so as be substantially parallel to said central member; and vii) said arcuate section of said second finger means being substantially longer in length than said arcuate section of said first finger means for bearing against the top front portion of a hat so as to maintain the natural shape thereof;

d) whereby when a hat is inserted between said first and second finger means of said at least one retaining clamp in a position that the top rear portion of the hat is folded under the top front portion thereof, said at least one retaining clamp displays the top front portion of the hat in its natural shape.

* * * * *